US005836530A

United States Patent [19]

Pilão

[11] Patent Number: 5,836,530

[45] Date of Patent: Nov. 17, 1998

[54] PAPER MANUFACTURE CONICAL-TYPE PULP REFINERS IMPROVEMENTS

[75] Inventor: Milton Pilão, São Paulo, Brazil

[73] Assignee: Pilao S/A Maquinas e Equipamentos, Brazil

[21] Appl. No.: 794,239

[22] Filed: Jan. 29, 1997

[30] Foreign Application Priority Data

Jan. 29, 1996 [BR] Brazil ..... 9600509-2

[51] Int. Cl.[6] ..... B02C 7/12

[52] U.S. Cl. ..... 241/261.1; 241/294; 241/295

[58] Field of Search ..... 241/261.1, 293, 241/294, 295, 300

[56] References Cited

U.S. PATENT DOCUMENTS

| | | | |
|---|---|---|---|
| 1,928,052 | 9/1933 | Fraser | 241/261.1 X |
| 4,874,136 | 10/1989 | Webster | 241/251 |
| 5,354,005 | 10/1994 | Mladota | 241/261.1 |
| 5,520,344 | 5/1996 | Fey et al. | 241/259.1 |

*Primary Examiner*—John M. Husar

*Attorney, Agent, or Firm*—Christie, Parker & Hale, LLP

[57] ABSTRACT

A paper manufacturing conical-type pulp refiner comprising a support structure 1 for a framework 2 with a front lid 3, and defining a refining internal and conical chamber 4, with a single and axial exit 5 and a radial side exit 6. The refiner further including a refining set including a rotatory axis 7, with the end centered inside the refining chamber 4, where the refining set itself is mounted, composed by a stationary conical pair and by a rotatory conical pairs, the latter interlayed between those, forming two refining conical surfaces. The rotatory conical pair being formed by a conical rotor 8 with the smaller base endowed with openings 9, involving an internal cylindrical cube 10 fixable on the rotatory axis 7 free end, receiving on its internal and external faces, the respective internal 11 and external 12 refining conical, thereon steadily disposed, composing a rayed conical rotor; and on their turn, the internal 13 and external 14 refining conical composing the stationary conical pair fixedly mounted respectively on the framework 2 refining chamber 4 bottom and on its front lid 3 internal face, directed respectively towards the rayed conical rotor internal 11 and external 12 refining conical, and with the consequent delimitation, among them, of two intermediate conical surfaces or refining zones.

10 Claims, 3 Drawing Sheets

8
9
10
11
12
13
14
"A"

PAPER MANUFACTURE CONICAL-TYPE PULP REFINERS IMPROVEMENTS

FIELD OF THE INVENTION

This invention relates to pulp refiners and more particularly to conical-type pulp refiners.

BACKGROUND OF THE INVENTION

Conical-type pulp refiners are already widely known, particularly in the paper manufacturing segment, due to being essentially composed by conical-shaped refining surfaces, which are assembled in a convenient way in order to have a relative rotation, so that the material to be refined, introduced in the surfaces internal edge and transported between them by means of centrifugal force, is peripherally unloaded, duly refined. Such conical refiners currently known are usually composed of a single pair of refining surfaces, one provided on a rotor element, naturally fixed to a rotating axis, and the other one on a stator element, fixed to the unit framework. Within the above concepts'scope, a simple type conical refiner is formed by a rotating refining head, axially fixed, which operates jointly with a rotating head too, axially adjustable. Another type is composed by a rotating head, also axially fixed, and by a non-rotating one, which disposes of means for an axial adjustment, aiming at altering the recesses between the refining conical surfaces.

Although said known conical refiners are broadly used in the paper manufacturing segment, some restrictions and even inconveniences may be mentioned, more particularly related to an unsatisfactory yield. Considering such units dimensions, and, taking into account that a possible refining surface's size increases, aiming at increasing refining yield would not be advisable, inasmuch as the thrust forces produced by the refining action would become significantly great, needing a very high motive force.

SUMMARY OF THE INVENTION

Thus, in view of these circumstances, and to overcome them, the paper manufacturing conical-type pulp refiner improvements of the present invention were designed, and which refer specifically to a high speed double refiner, having double rotating floating conicals. In other words, the improved set of the present invention comprises a double refiner, having a pair of stationary conicals, that is, non-rotative and axially fixed between the rotating conicals. This composition essentially constitutes the novelty, inasmuch as the refining surfaces themselves, assembled on the corresponding stationary and rotating conicals, operate jointly in a conventional fashion, in order to carry out a friction action in the materials passing between them. The rotating head is assembled on the rotating axis end, which floats inside the refining chamber, and the set also includes an adjustment system assembled on the refiner lid, through which the forces developed by the rotating head are equaled.

Briefly, one embodiment of the invention is a paper manufacturing conical-type pulp refiner including a support structure supporting a horizontally disposed framework. A front lid on the framework internally defines a refining chamber having a conical shape with an axial entrance centered on the front lid for the material to be refined. The refiner further includes a radial side exit for refined material. A refining set is positioned within the framework comprising a stationary conical pair and a rotary conical pair in a ray between the stationary conical pair thus forming two refining conical surfaces.

Thus, the main object of the present invention consists in a high speed double conicals improved refining set, to be used to refine pulp to manufacture paper or similar goods, the mentioned set having a rotating floating conical which minimizes the thrust forces transmitted by the refiner axis, thus permitting an energy reduction due to the refined material quantity increase.

Another object of the present invention is to present a double conical refiner improved set which, when taken into confrontation with conventional conical refiners, can be built and maintained more easily, practically and economically.

DETAILED DESCRIPTION

Figures 1, 2, 3:
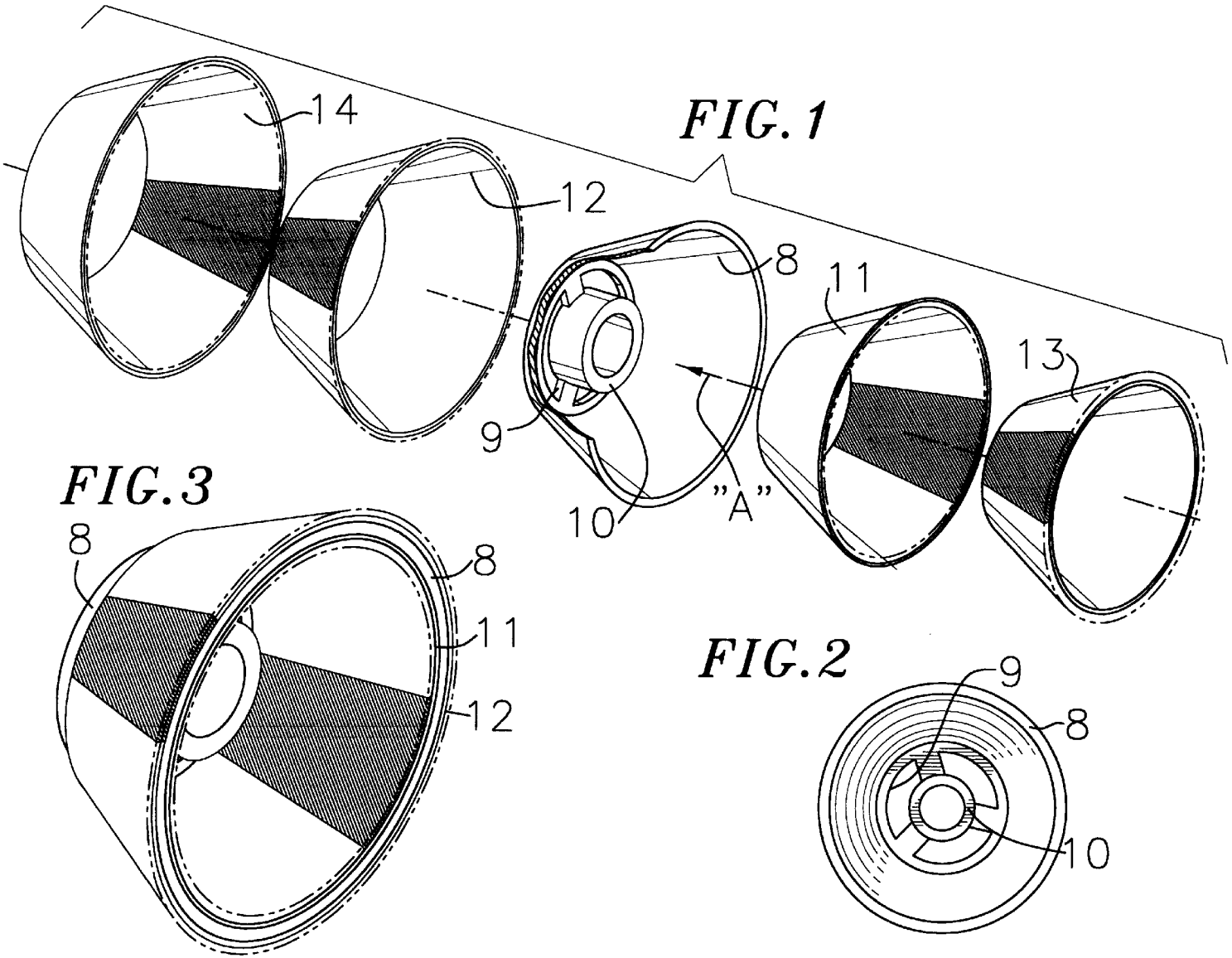
FIG. 1 shows, in exploded perspective and with partial cuts, the elements composed of refiner rotating and stationary conicals pairs, and embodies the present invention.
FIG. 2 is a cross-sectional view of the unit conical rotor, indicated according to the arrow "A" in FIG. 1.
FIG. 3 is a perspective of a rayed conical rotor composed of unit rotor and an improved refiner rotating conicals pair.

In conformity with the illustrations of by the aforementioned figures, the paper manufacture conical-type pulp refiners improvements, which constitute the present invention objective, initially comprise a support structure 1 (FIG. 4), which sustains a framework 2, horizontally disposed and with a front lid 3, said set of framework 2 and front lid 3, internally defining a conical-shaped refining chamber 4, with sole and axial entrance 5 of the material to be refined, centered on the front lid 3 itself, and radial side exit 6 of the material already refined, the set also including a rotatory axis 7, naturally supported by the support structure 1, advancing into the framework 2 interior and with the free end centered inside the mentioned refining conical and internal chamber 4.

Inside the structural set thus formed, and more specifically inside the refining conical chamber 4, the refining set itself is mounted, including a stationary conicals pair and a rotatory conicals pair, the latter positioned between the former, thus defining two refining conical surfaces.

As to the pair of rotatory conicals aforementioned, it is formed as from a conical rotor 8 (FIGS. 1 and 2), with the smaller base having an opening circumferential alignment 9, passage for the material, and involving an internal and axial cylindrical tube 10, firmly applicable, but with axial adjustment possibility, on the rotatory axis 7 free end, the referred conical rotor 8 receiving, on their respective internal and external faces, the corresponding refining conical, internal 11 and external 12, where they stay steadily disposed, thus composing a rayed conical rotor (FIG. 3).

Figure 6:
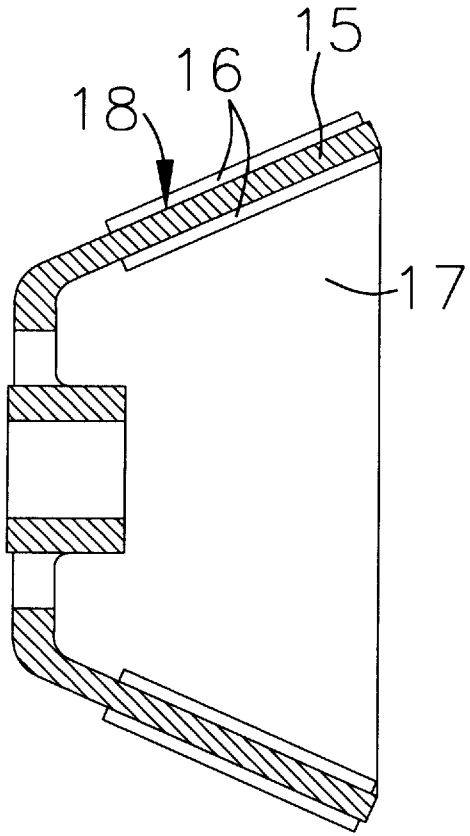
FIG. 6 is a cross-sectional view of FIG. 5.
Figure 5:
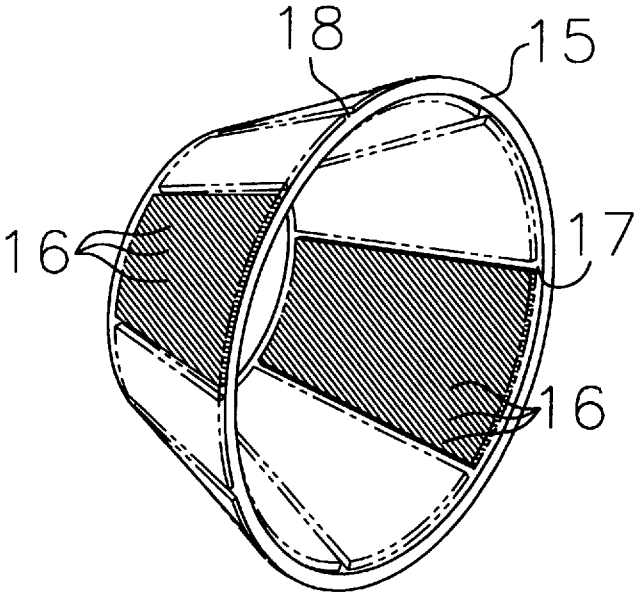
FIG. 5 is a perspective view of an alternative embodiment of the invention illustrating a rayed conical rotor.

Obviously, and in another embodiment, as shown in FIGS. 5 and 6, the rayed conical rotor might be formed as from an identical rayed conical 15, also fixable on the refiner rotatory free end, and itself endowed with double refining face, by the application of refining blades or wings 16 on the very conical rotor internal 17 and external 18 faces.

Figure 4:
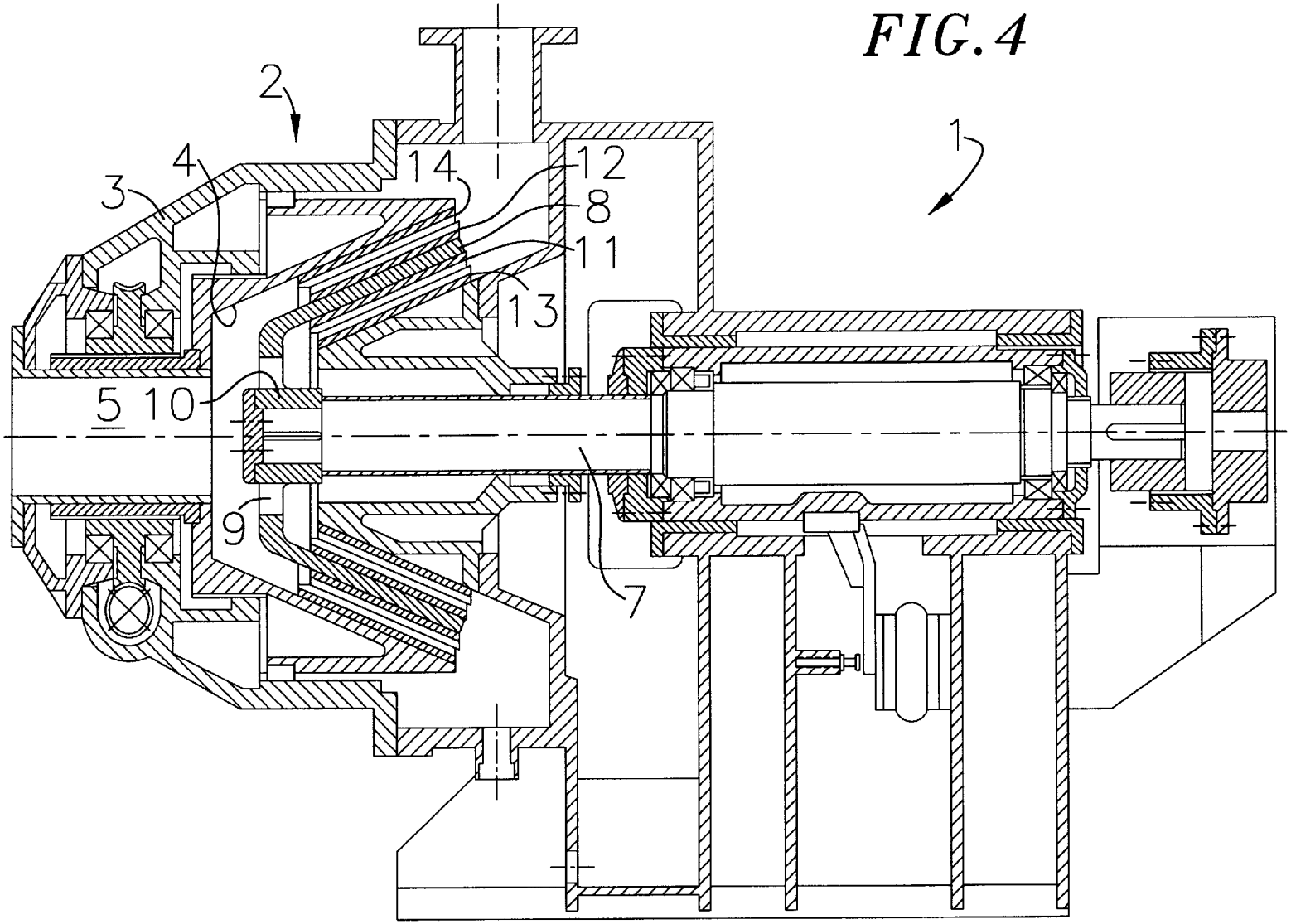
FIG. 4 is a cross-sectional view of an improved conical refiner, with the stationary and rotating conicals pairs duly assembled in its interior.

On its turn, and additionally, the stationary conical pair, that is, the internal conical refiner 13 and the external conical refiner 14 are fixedly mounted, but also with axial adjustment possibilities, respectively on the refining chamber bottom 4 of framework 2 and on said chamber front lid 3 internal face, positioned directly towards the internal 11 and external 12 conical refiners of the rayed conical rotor, and with the consequent delimitation, between them, of two intermediate conical surfaces or refining zones (FIG. 4)

Thus, the material to be refined, entering into the present invention improved refiner through the front lid 3 entrance central opening 5 (FIG. 4), moves directly against the rayed conical rotor smaller base, from where it is decomposed in two flow streams, one of which is directed through the space limited between the external stationary refining conical 14, mounted internally to the unit front lid 3, and the rotatory refining conical 12 of the conical rotor external face 8, and the other one trespassing the openings 9 of the conical rotor internal face 8 and the internal stationary refining conical 13, mounted on the bottom of the refining chamber 4.

Those two material flow streams after the due refining which occurs by its passage through the two refining zones, are eventually referred to a ring-shaped space formed in the same refining chamber 4 bottom, and the flowing by the unit radial side exit 6.

It is important to point out, as one of the main particularities of the present invention improved set, the fact that the unique rayed conical rotor provides a double flow operation, having only one axial entrance for the material to be refined, and one single exit for the material already refined.

In other words, the material to be refined entering through the single axial entrance flows through the cracks between the rotatory and stationary refining conical into the respective refining areas, two refining units being present in a single machine.

The rayed conical rotor allows half the pulp to pass through the first conical pairs (one of them stationary, the other one rotatory), the other half passing through the conical rotor top openings to reach and pass by the conical second pair (one of them rotatory, the other one stationary), thus characterizing two material parallel flows passing through the conical pair surfaces, which are then joined and leave the unit through the single radial side exit.

It is also important to point out the possibility, upon the excessive wearing of any one of the referred improved set refining conical, of said set being easily detached from its position, either on the lid 3 internal face or on the refining chamber 4 bottom, in case it be stationary, either on the rayed conical rotor internal or external face, if it be rotatory.

The disclosure of attached Brazil patent application Serial No. 9600509-2, filed on Jan. 29, 1996 is incorporated fully herein by reference. Priority of the Brazil application is claimed.

What is claimed is:

1. A paper manufacturing conical-type pulp refiner comprising:

a support structure (1) supporting a horizontally disposed framework (2), a front lid (3) internally defining a refining chamber (4) having a conical shape with an axial entrance (5) centered on the front lid for material to be refined, a radial side exit (6) for the material already refined, and;

a refining set comprising a stationary conical pair, (13, 14), and a rotatory conical pair having a spoked axial opening, the rotary conical pair including a first rotor and a separate second rotor positioned between the stationary conical pair, thus forming two refining conical surfaces.

2. The paper manufacturing conical-type pulp refiner according to claim 1, wherein the rotatory conical pair includes a third conical rotor (8) positioned between the first rotor and the second rotor having a base with the spoked axial opening; and a passage for the material including an internal and axial cylindrical tube (10), said conical rotor (8) receiving the first rotor and the second rotor, thereby comprising an array of conical rotors.

3. The paper manufacturing conical-type pulp refiner according to claim 2, wherein the array of conical rotors includes internal and external faces each having refining blades extending therefrom.

4. The paper manufacturing conical-type pulp refiner according to claim 2, wherein the stationary conical pair, comprises an internal refining conical (13) and an external refining conical (14) fixedly mounted in a rotational direction on the framework (2) and thereby defining along with the rotating conical pair two intermediate conical surfaces.

5. The paper manufacturing conical-type pulp refiner according to claim 2, wherein the stationary conical pair, comprises an internal refining conical (13) and an external refining conical (14) fixedly mounted in a rotational direction on the framework (2) and thereby defining along with the rotating conical pair two refining zones.

6. The paper manufacturing conical-type pulp refiner according to claim 1, wherein the stationary conical pair, comprises an internal refining conical (13) and an external refining conical (14) fixedly mounted, in a rotational direction on the framework (2) and thereby defining along with the rotating conical pair two intermediate conical surfaces and two refining zones.

7. A paper manufacturing conical-type pulp refiner comprising:

a support structure (1) supporting a horizontally disposed framework (2);

a front lid (3) connected to the framework defining a refining chamber (4) having a conical shape with an axial entrance (5) centered on the front lid for entrance of material to be refined;

a radial side exit attached to the refining chamber for refined material;

a first conical stator positioned in the refining chamber;

a second conical stator positioned in the refining chamber within the first stator; and a rotor positioned between the first and second stators having a separate outer refining cone positioned on an outer surface of the rotor and a separate inner refining cone positioned on an inner surface of the rotor, and a spoked entrance hub to distribute the material to be refined towards the inner and outer refining cones.

8. The pulp refiner of claim 7 wherein the outer refining cone has a plurality of refining blades on an outer surface of the cone.

9. The pulp refiner of claim 7 wherein the inner refining cone has a plurality of refining blades on an inner surface of the cone.

10. The pulp refiner of claim 7 wherein the first stator has refining blades on an inner surface of the first stator and the second stator has refining blades on an outer surface of the second stator.

* * * * *